US012312899B2

(12) United States Patent
Norvila et al.

(10) Patent No.: US 12,312,899 B2
(45) Date of Patent: May 27, 2025

(54) POWERED CLAMP ASSEMBLY

(71) Applicant: Beyond Energy Services and Technology Corp., Calgary (CA)

(72) Inventors: Charles Erle Norvila, Blackfalds (CA); Stewart George Wilson, Red Deer (CA); Scott Rypstra, Red Deer (CA); George James Michaud, Beaumont (CA)

(73) Assignee: Beyond Energy Services and Technology Corp., Calgary (CA)

( * ) Notice: Subject to any disclaimer, the term of this patent is extended or adjusted under 35 U.S.C. 154(b) by 0 days.

(21) Appl. No.: 18/585,993

(22) Filed: Feb. 23, 2024

(65) Prior Publication Data

US 2024/0287865 A1 Aug. 29, 2024

(30) Foreign Application Priority Data

Feb. 24, 2023 (CA) ..... CA 3191093

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 5,662,181 | A * | 9/1997 | Williams | E21B 33/085 166/84.3 |
| 9,163,473 | B2 * | 10/2015 | Linde | E21B 33/064 |
| 10,738,558 | B1 * | 8/2020 | Orbell | E21B 33/085 |
| 11,326,415 | B2 * | 5/2022 | Orbell | E21B 21/08 |
| 11,525,324 | B2 * | 12/2022 | Downie | F16B 2/10 |
| 2017/0051785 | A1 * | 2/2017 | Cooper | F16C 33/7886 |

FOREIGN PATENT DOCUMENTS

WO 2021163784 A1 8/2021

* cited by examiner

*Primary Examiner* — Matthew R Buck
(74) *Attorney, Agent, or Firm* — PCFB, LLC; Justin K. Flanagan

(57) ABSTRACT

A powered clamp assembly for use on a rotating control device on a managed pressure drilling rig may comprise a first jaw and a second jaw. Each one of the jaws may include a pivot extremity and a locking extremity. Each pivot extremity may include a structural member jutting outwardly from its respective jaw and pivotally connected to a bridging means. The pivot extremity of each of the first and second jaws may be set opposite one another. Each of the locking extremities may be connected to a closure means. The locking extremities of the first and second jaws may be set opposite one another. The movement of the first jaw and the second jaw may allow movement of the jaws between a proximal position in relation to each other and a distal position.

17 Claims, 6 Drawing Sheets

POWERED CLAMP ASSEMBLY

RELATED APPLICATIONS

This application claims priority to Canadian Patent Application No. 3,191,093, titled "Powered Clamp Assembly," filed on Feb. 24, 2023, which is hereby incorporated by reference in its entirety.

TECHNICAL FIELD

The present invention relates to a powered clamp for use in the oil and gas industry, more specifically a powered clamp assembly for use on an rotating control device (RCD).

BACKGROUND

When drilling for oil and gas, one encounters geological formations that have a narrower tolerance for changes in bottom hole pressure. A widely adopted solution to this problem is the so called 'Managed Pressure Drilling' (MPD). In this method of drilling, the annular space is closed to the atmosphere by means of a Rotating Control Device (RCD). An RCD is a pressure-control device (e.g., as part of a pressure drilling rig) used during drilling for the purpose of making a seal around the drillstring during its rotation and/or tripping in and out of a well. The RCD is designed to contain or divert hydrocarbons or other wellbore fluids and pressure and prevent their release to the atmosphere. The RCD diverts the fluid into a manifold equipped with a specialized choke that allows manipulation of the well's bottom hole pressure. Right before breaking a connection to add a new stand, the pumps are ramped down. At the same time, the dynamic component of the bottom hole pressure drops and needs to be compensated for, in order to maintain a near-constant bottom hole pressure.

In the oil and gas industry, it is paramount to ensure the safety of employees. A problem that may jeopardize employees' safety on a drilling rig is known as a "blowout". When a zone of high geopressure is encountered during a drilling operation and the pressure exceeds the hydrostatic pressure exerted by the drilling mud, and the formation has sufficient permeability to allow fluid flow, then the formation fluid will move into the wellbore and displace the drilling mud. This is referred to as a "kick"; and if unchecked it will result in a "blowout" which is an uncontrolled release of crude oil and/or natural gas from an oil well. Through the use of an MPD system which includes an RCD, a kick can be safely controlled.

U.S. Pat. No. 9,163,47, titled "Remote Operation of a Rotating Control Device Bearing Clamp and Safety Latch," granted on Oct. 20, 205, which is hereby incorporated by reference, has disclosed an RCD which includes a housing assembly which contains a sealing assembly and an annular seal which rotates and seals off an annulus between a tubular string and an RCD body, a remotely operable clamp device which selectively permits and prevents relative displacement between the sealing assembly and the body, and a remotely operable safety latch which selectively permits and prevents unclamping of the clamp device. A method of remotely operating an RCD clamp device can include remotely operating a safety latch which selectively permits and prevents unclamping of the clamp device, and remotely operating the clamp device while the safety latch is in an unlatched position, thereby unclamping a scaling assembly housing assembly from the RCD body. Another RCD can include a remotely operable clamp device which selectively permits access to an RCD body interior, and a remotely operable safety latch which selectively prevents unclamping of the clamp device.

Despite the existing prior art, there still exists a need for a robust, reliable powered clamp assembly to seal the wellbore from the atmosphere during managed pressure drilling. Preferably, such a clamp should also be operable remotely to increase the personnel's safety around the wellbore.

Most of the existing art that exists around RCD clamps still result in having a person atop the annular BOP to install a safety pin or means of ensuring the clamp remains closed in the event of loss of hydraulic pressure. Manual clamp technology causes an operator to place a person atop the annular so as to open/close the manual clamp which in turn introduces a significant safety concern especially when dealing with hydrocarbons and pressure. Preferably such a clamp should also include a safety mechanism or method that ensures the clamp remains closed in the event of the loss or malfunction of its power source.

Previously, International Patent WO2021/163784 A1, titled "Powered Clamp Closure Mechanism," published on Aug. 26, 2021, which is hereby incorporated herein by reference, describes a remotely controlled clamping mechanism that meets many of the requirements to safely clamp and unclamp an RCD remotely. However, said device did not meet the robust requirements necessary for field application thus necessitating the design of a device that improves operational reliability during managed pressure drilling operations.

SUMMARY

Accordingly, there is provided a powered clamp assembly for use on an RCD which allows the RCD and accessories to be installed or retrieved without having any personnel atop the annular BOP during critical operations.

According to an aspect of the present invention there is provided a powered clamp assembly for use on an RCD comprising:

a. a first jaw and a second jaw, each one of said jaws comprising a pivot extremity and a locking extremity, each one of said pivot extremity comprising a structural member jutting outwardly from its respective jaw and pivotally connected to a bridging means; wherein said pivot extremity of each one of said first and second jaw are set opposite one another; and b. each one said locking extremity is connected to a closure means; wherein said locking extremity of each one of said first and second jaw are set opposite one another; and wherein the movement of said first jaw and said second jaw allows movement of said first and second jaws between a closed position where the locking extremity of said first and second jaws are in a first proximal position in relation to each other and an open position where the locking extremity of said first and second jaws are in a second distal position relative to one another.

According to a preferred embodiment of the present invention, there is no need for a pin or any other manual safety device. Due to the self-locking nature of the powered system, pressures can be trapped against the hydraulic cartridge valve and therefore ensure the continuous and uninterrupted activation of the closure mechanism regardless of the state of the power source.

According to a preferred embodiment, the closure means maintains contact with the locking extremity of each one of said first and second jaw when such are in said distal position in relation to each other.

According to a preferred embodiment, the load holding and locking means includes or consists of a powered linear actuator that has reversible and continuously variable position between full extension and full retraction.

According to a preferred embodiment, the closure means are actuated remotely. Preferably, the powered clamp assembly further comprises an inner circumferential shape created by the first and second jaw when in a closed position such that it frictionally engages the tubing around which it is disposed.

According to an aspect of the present invention, there is provided a powered clamp assembly for use in managed pressure drilling which is expandable through a combination of a pivot and articulations between a substantially open position and a substantially closed position. One of the advantages of the present invention is the capacity to maintain the alignment of a first jaw and a second jaw, upon opening so that upon closure said first and second jaw are in alignment. Said first jaw and second jaw each having a first extremity and a second extremity, wherein said first extremity of said first jaw and said second jaw are positioned proximate one another, and wherein the second extremity of said first jaw and said second jaw are in abutment with one another when said powered clamp is in a closed position and second extremity of said first jaw and said second jaw are spread apart when said powered clamp is in an open position.

According to a preferred embodiment, each one of said first and second jaw are pivotally mounted to a pivot point. Preferably, each one of said first and second jaw are pivotally mounted to a first and a second pivot point respectively. Preferably, the first and second pivot points are positioned proximate each other. Preferably, each jaw covers half of the circumference of a tube on which it is applied. More preferably, each jaw has an inner circumferential shape in order to adapt to the contour of the tube upon which it will be applied and be tightened. Preferably, each jaw's shape is adapted to form a tight lock on the tube upon which it is meant to be tightened and be complementing of each other's geometry to surround the entirety of the tube's circumference.

According to a preferred embodiment of the present invention, the second extremity of said first jaw and second jaw are secured together using a locking extremity. Preferably, the second extremity of said first jaw and second jaw are maintained in permanent connection with one another through a bridging means that comprise a single pivot point onto the two jaws.

According to a preferred embodiment, there is no need for a safety pin or any other manual safety device. This is achieved through the self-locking nature of the powered system to trap pressure against a hydraulic cartridge valve which secures the closure mechanism.

According to a preferred embodiment of the present invention, the means of load holding and locking are homologized. The linear actuating mechanism provides both functions through the multiple cylinder arrangements. The means of load holding and locking of the powered clamp ensures the closure of the jaws by trapping pressure against a hydraulic cartridge valve.

According to a preferred embodiment of the present invention, the clamp sections are moved to either the open or closed position by a multiple opposed cylinder arrangement. The cylinder arrangement is used to open/close and perform load holding/locking of the two clamp halves.

According to a preferred embodiment of the present invention, the powered clamp assembly comprises the position sensors that can be used for indicating the positional status of the assembly remotely. The removal of the need for direct visual confirmation of apparatus position contributes to increase the personnel's safety around the wellbore.

According to a preferred embodiment of the present invention, said first and second jaw each having an inner surface adapted to contour an outer surface of said RCD where said powered clamp assembly will come into contact.

BRIEF DESCRIPTION OF THE FIGURES

Features and advantages of embodiments of the present application will become apparent from the following detailed description and the appended figures, in which.

DETAILED DESCRIPTION

Figure 1:
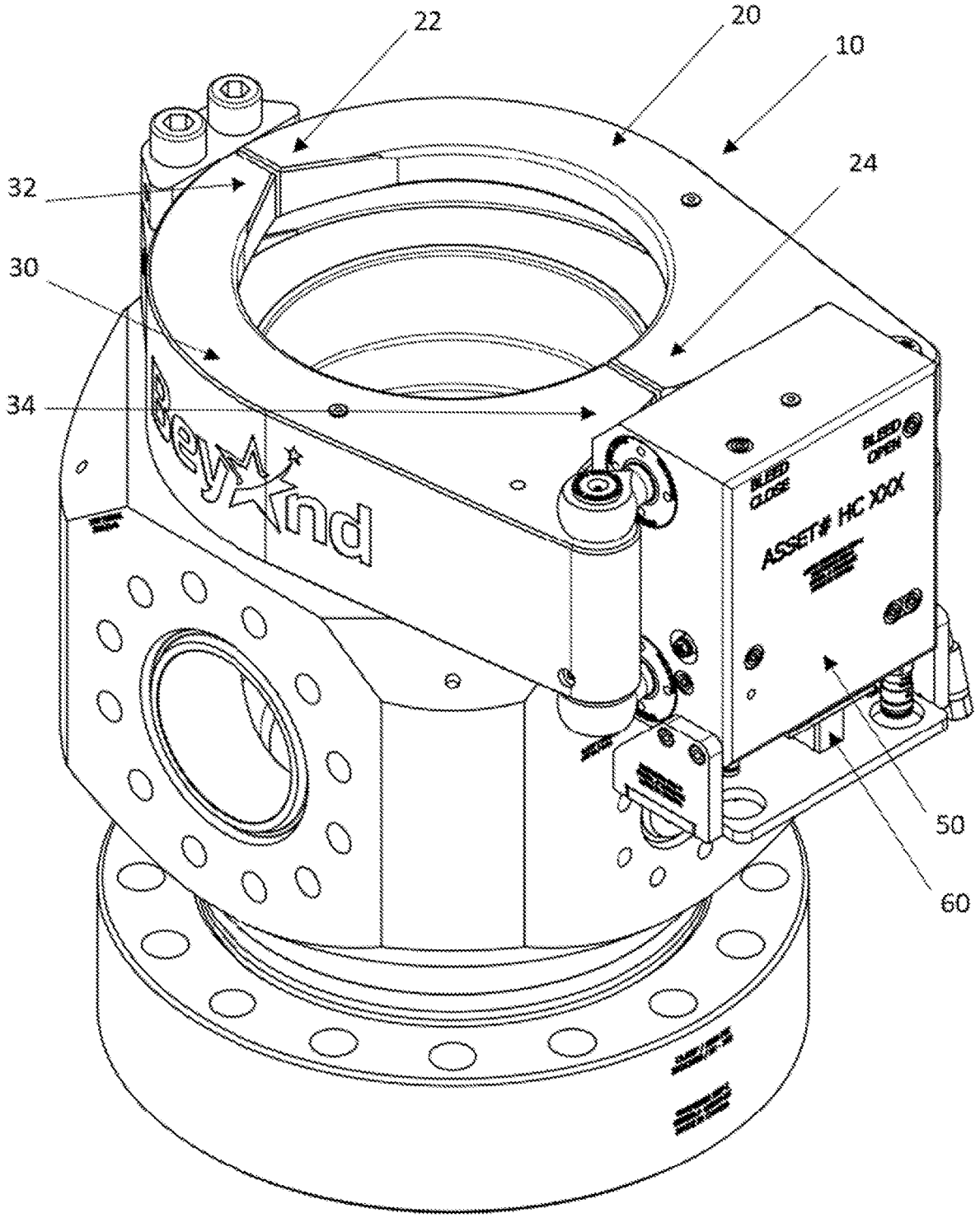
FIG. 1 is a front perspective view of the powered clamp according to a preferred embodiment of the present invention in the closed position.
Figure 2:
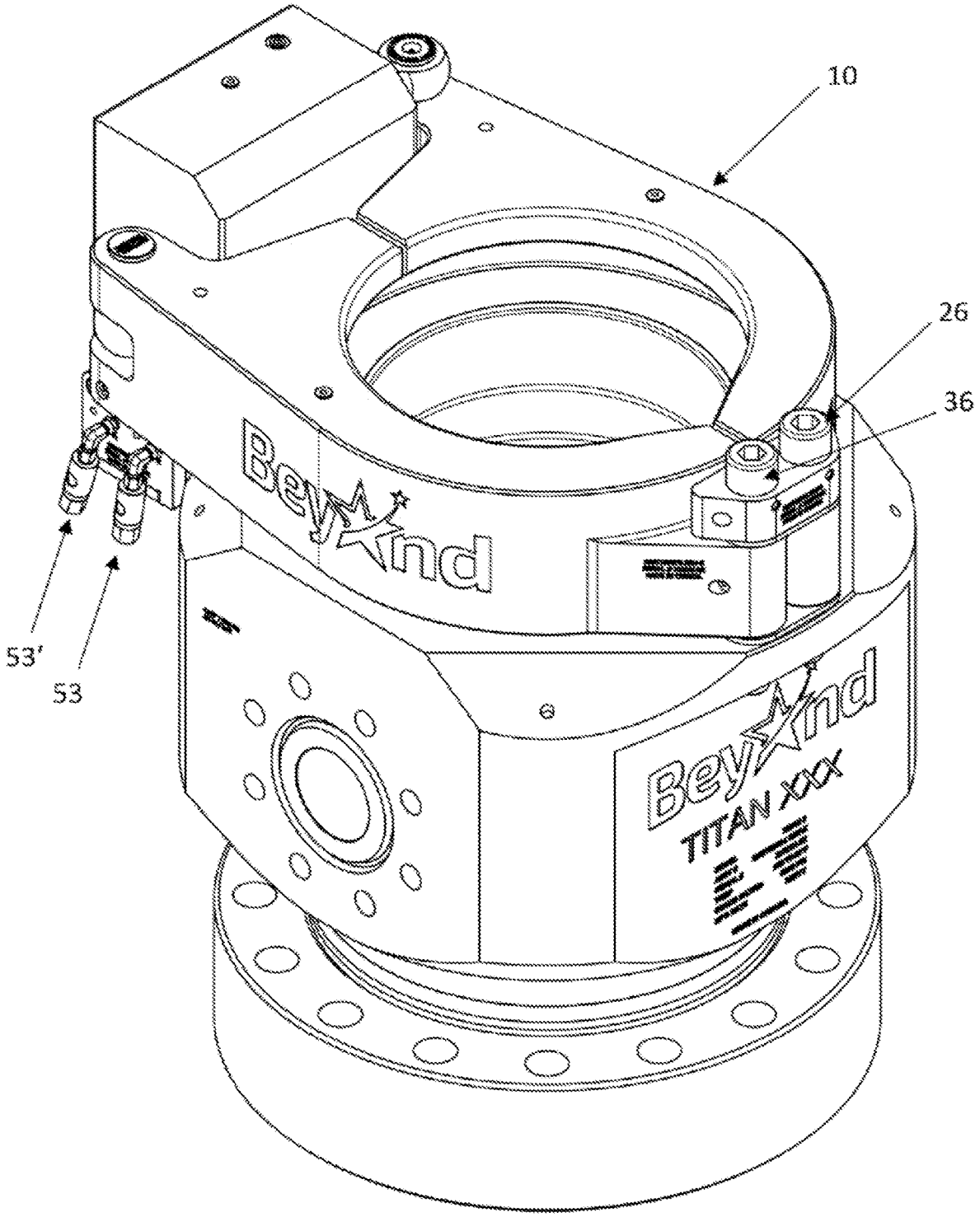
FIG. 2 is a rear perspective view of the powered clamp according to a preferred embodiment of the present invention in the closed position.

As seen in FIGS. 1 to 4, the powered clamp assembly (10) according to the preferred embodiment of the present invention comprises a first (20) and a second jaw (30). Each one of said jaws comprising a pivot extremity (22, 32), and a locking extremity (24, 34). Each one of said pivot extremity (22 and 32) comprising a member (25, 35) (e.g., a structural member) jutting outwardly from the jaw (20, 30) and pivotally connected to a bridging means (40) (e.g., an upper bridging element and/or a lower bridging element (42) through a pin (26, 36) or any equivalent mechanical component which permits rotation. Optionally, and as illustrated, the bridging means (40) may comprise an upper bridinging element and a lower, second bridging element (42) located under the members (25, 35). Alternatively, the bridging means may extend from the top side (27, 37) of the members (25, 35) to the bottom side (not shown) as a single piece. According to an alternative embodiment, the bridging means can comprise a single pivot point onto which both members jut thereunto.

As shown in the preferred embodiment, the locking extremities (24, 34) of the jaws (20, 30) are in permanent connection with one another through a closure device, such as a linear actuating mechanism (50) which comprises of multiple opposed cylinder arrangements and an anchoring/alignment mechanism (which acts much like a support bracket and centering block)(60) to allow the opening and closing of the jaws while maintaining them in a centralized alignment. Correct alignment of the two jaws upon closure of the clamp is highly desirable as the internal surfaces of each jaw must contour the tubing with as much surface as possible to ensure effectiveness of the clamp. Thus, the inner circumferential shape created by the first and second jaw when in a closed position should be such that it geometrically, fittingly, complimentarily, and/or frictionally engages the neck of the tube (or protruding portion of the tube) around which it is disposed. Preferably, the profile of the clamps matches (complimentarily) the profile formed by the body neck and RCD or accessory. Alternative closure means and variations are possible within the scope of the illustrated examples and description herein.

Figure 3:
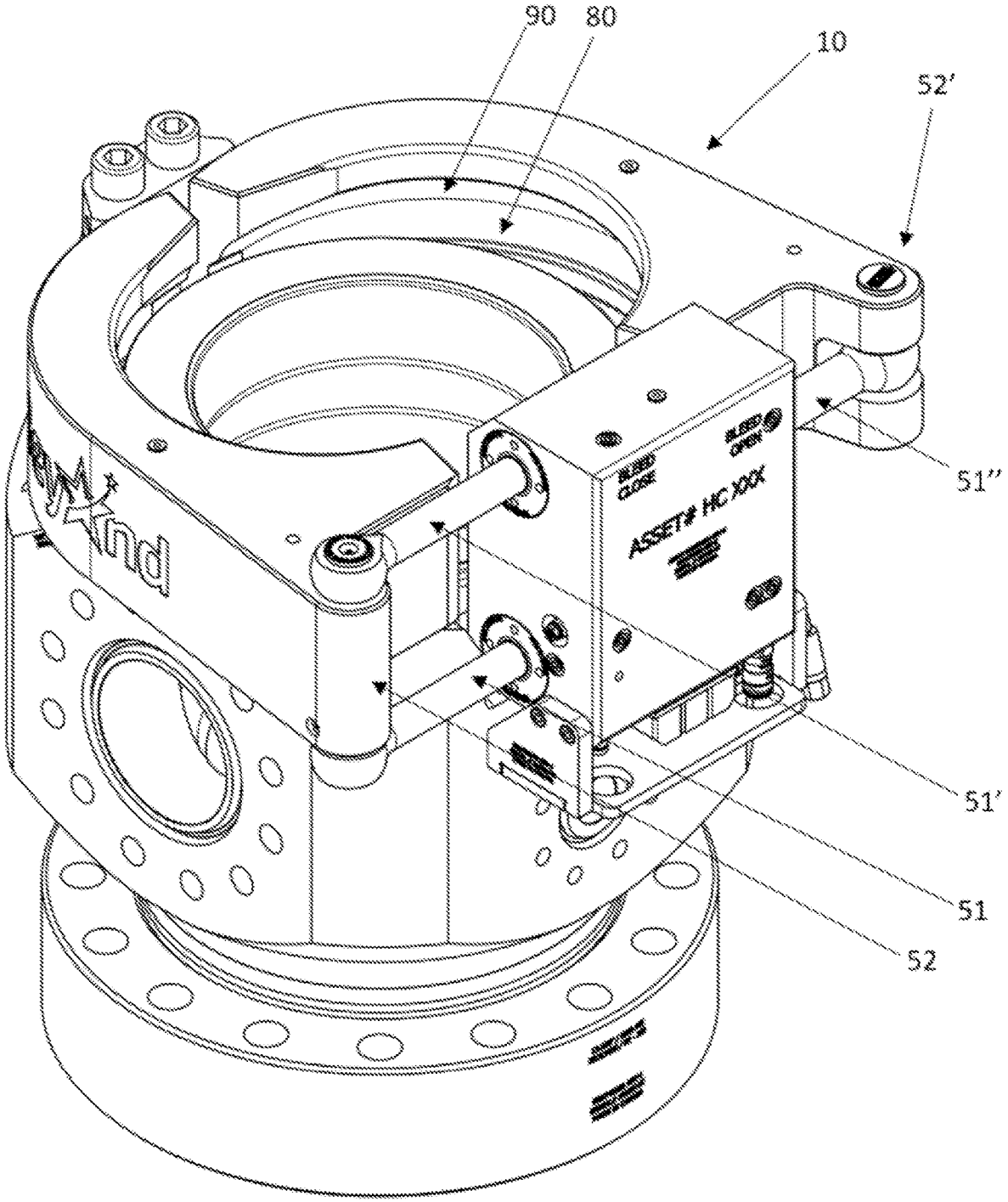
FIG. 3 is a front perspective view of the powered clamp according to a preferred embodiment of the present invention in the open position.
Figure 4:
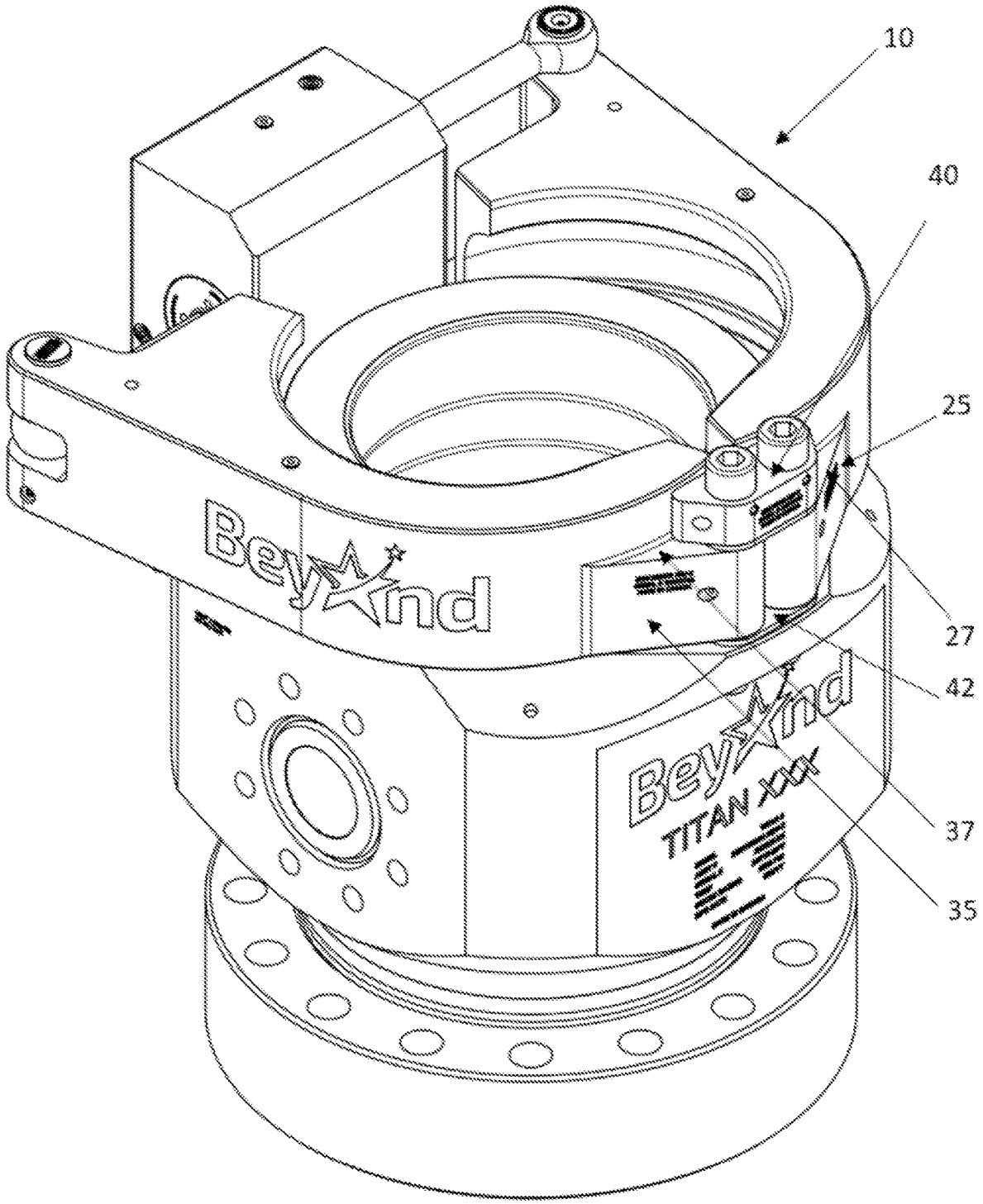
FIG. 4 is a rear perspective view of the powered clamp according to a preferred embodiment of the present invention in the open position.

According to a preferred embodiment and as shown in FIGS. 3 and 4, one notes that the internal surface of the jaws is not flat but rather it has grooves (80 and 90) adapted to contour a specific type of RCD and/or accessories set-up. The internal surface of the jaws (grooves or no grooves) in no way affects how the clamp assembly operates; it just determines RCD body, RCD, and accessory compatibility. According to a preferred embodiment of the present invention, said first and second jaw each interact with the profile of the RCD, wherein the first and second jaws have an inner profile adapted to contour the outer profile of said RCD. Preferably, the first and second jaw inner profile provide a complimentary fit between said clamp and said RCD. To have a complimentary fit to a surface, is to be understood in the present case, for a surface to have at least two contact points with another surface. Preferably, a complimentary fit indicates that a surface have multiple contact points or large surfaces being in contact with one another.

According to the preferred embodiment illustrated in FIGS. 1 to 4, the closing mechanism includes or consists of a linear actuating mechanism (50) comprising multiple opposed cylinder arrangements (51, 51', 51") actuating the two unsymmetrical pivots points (52, 52') so as to move the jaws between an "open" position and a "closed" position.

According to a preferred embodiment of the present invention, each pivot point is connected to the linear actuating mechanism (50) via the multiple cylinder arrangements (51, 51', 51") which also provides load holding and locking functions. The fittings (53, 53') in conjunction with a limit valve provide a means to detect and confirm closure of the closing mechanism while trapped hydraulic pressure against a hydraulic cartridge valve ensures a secure locking of the jaws together during the performance of the powered clamp assembly (10). Preferably, the means to detect closure can be performed pneumatically, electrically, mechanically, or hydraulically with various switch mechanisms. The hydraulic cartridge valve may include a counterbalance valve, a pilot-operated check valve, and/or a load control valve.

The preferred embodiment of the powered clamp comprises actuators to move the two jaws between a first closed position (see FIGS. 1 and 2) where the clamp is fully shut (retraction) and a second extension position where the two jaws are in an open position (relative to one another) where their respective locking extremities are in a position distal from each other (see FIGS. 3 and 4).

Preferably, the actuator can be mechanically driven, electrically driven, pneumatically driven, or hydraulically driven. A power source, directed through a switching element, operates the opposed cylinders to tighten or release the jaws and cause their displacement.

As seen in FIGS. 3 and 4, the preferred embodiment of the locking mechanism is indistinguishable from the closing mechanism and is made up of multiple cylinder arrangements which are hydraulically actuated. A separate latching mechanism is not required and this is believed to be highly desirable as it simplifies the design to improve reliability to provide a safe closure all the while providing the operator a means to actuate it remotely. In addition to remote operation, position indication sensors are used to remotely indicate the status of the position of the assembly. The sensor may sense and communicate a state of the closure device (e.g., open or closed). The sensor may comprise a proximity sensor, a limit valve, and/or a limit switch. This removes the need for direct visual confirmation of apparatus position which also enhances safety and operational efficiency.

Figure 5A:
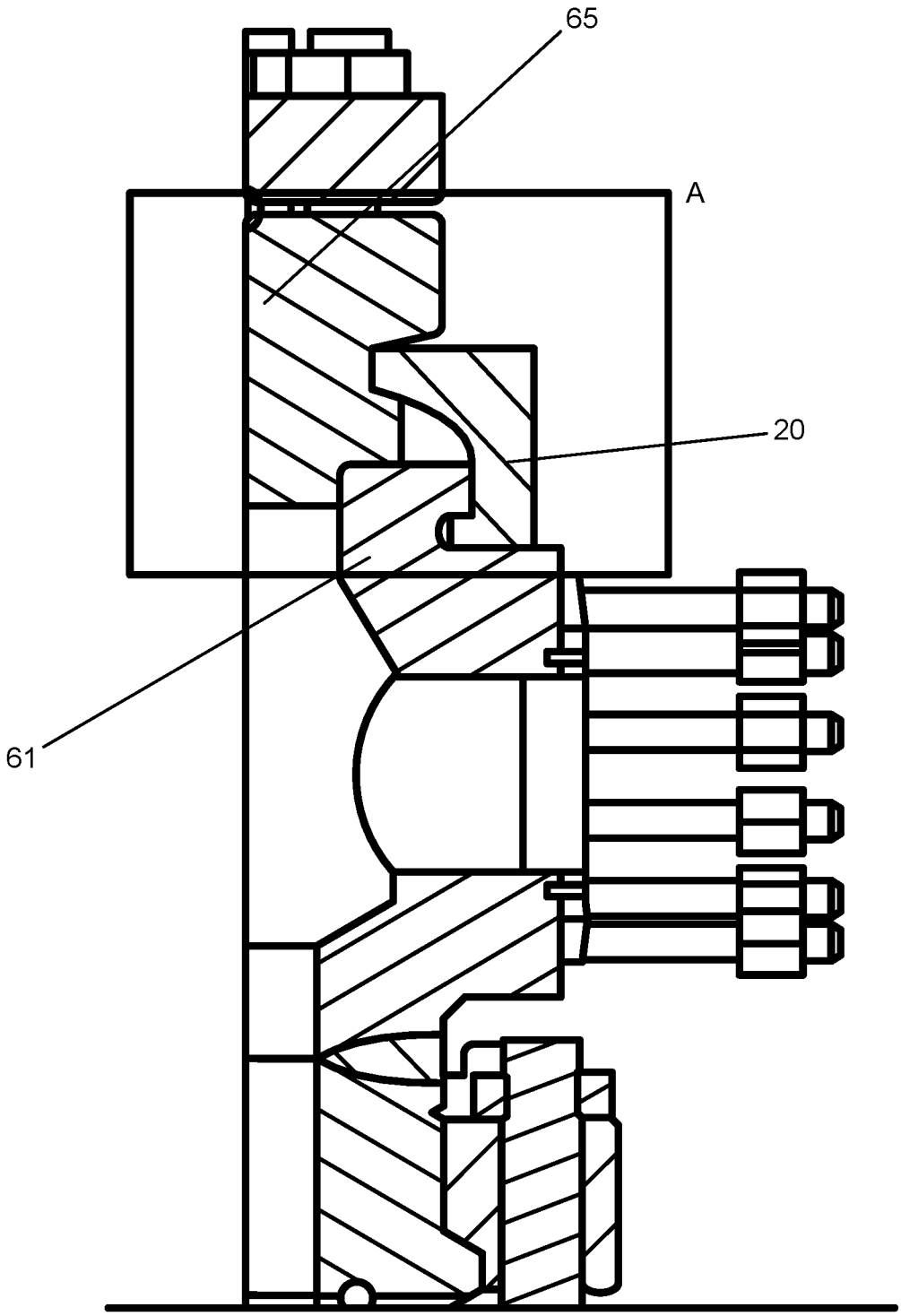
FIG. 5A is a cross-sectional view of the powered clamp according to a preferred embodiment of the present invention in the closed position around a RCD as seen in FIG. 4.
Figure 5B:
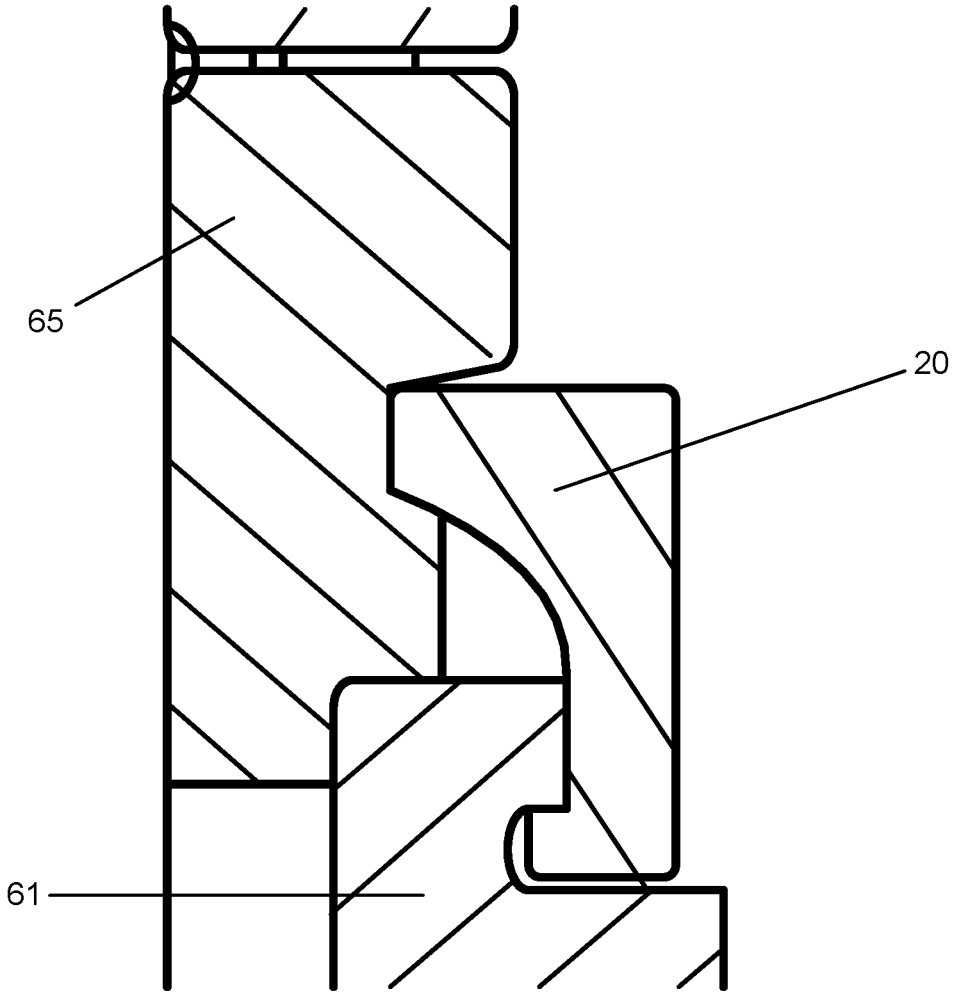
FIG. 5B is a close up of the cross-sectional view of the powered clamp according to a preferred embodiment of the present invention in the closed position around a RCD as seen in FIG. 4.

FIG. 5A shows the cross-section where the connection between the sealing assembly (65), the edge of the RCD (61), and one of the clamps (20) of the powered clamp according to a preferred embodiment of the present invention. FIG. 5B is a close-up of cross-section "A", labelled "A" (in FIG. 5A), highlighting the complementarity of the fit between the jaw (20) of the powered clamp assembly and the RCD (partially illustrated by element 61) and the sealing assembly (65).

According to a preferred embodiment, there is no need for a safety pin or any manual safety device. This is achieved through the self-locking nature of the powered system to trap pressure against a hydraulic cartridge valve which directs the closure mechanism. In the closed position, the operating surfaces are shielded from environmental factors which improves system reliability.

According to a preferred embodiment, one of the means of motion to achieve clamp opening and closing is using opposing multiple acting cylinders as compared to a screw drive or multiple linkages, as the prior art document discussed earlier. According to a preferred embodiment of the present invention, the open/close cylinders move the clamp through a linear mechanism which allows the powered clamp assembly to be much more reliable in operation while when in the closed position the design shields any moving parts from any possible damage which could be potentially caused by impacts from other objects being lifted or moved.

According to a preferred embodiment of the present invention, when in use the clamp can be tightened around a tube remotely either wirelessly or through a cable connected to the powered clamp. The operator, who is located at a safe distance from the wellbore and hence the powered clamp, enters instructions or operates controls which are meant to release the lock mechanism. Once the controls have been operated, the closure is opened in one continuous step and the clamp's grip is loosened to allow the RCD or accessories to be removed or installed into the RCD body.

As is understood by the person skilled in the art to which this disclosure is addressed, the pivot extremity, the locking extremity, and the locking mechanism can take different forms but still be considered to be part of the inventive concept as described and illustrated herein. The embodiments described herein are to be understood to be exemplary and numerous modification and variations of the present invention are possible in light of the above teachings. It is therefore to be understood that within the scope of the claims appended hereto, the invention may be practiced otherwise than as specifically disclosed herein.

The invention claimed is:

1. A powered clamp assembly for use on a rotating control device on a managed pressure drilling rig comprising:

a. a first jaw and a second jaw, each one of said jaws comprising a pivot extremity and a locking extremity, each one of said pivot extremity comprising a structural member jutting outwardly from its respective jaw and pivotally connected to a bridging element to maintain a permanent connection between the pivot extremity of the first jaw and the pivot extremity of the second jaw; wherein said pivot extremity of each one of said first and second jaw are set opposite one another, and wherein said pivot extremity of said first and second jaw share a common pivot point, and b. each one of said locking extremity is connected to a closure device that includes a multiple opposed cylinder arrangement to maintain the first and second jaws in a centralized alignment; wherein said locking extremity of each one of said first and second jaw are set opposite one another; and wherein movement of said first jaw and said second jaw allows movement of said first and second jaws between a closed position where the locking extremity of said first and second jaws are in a first proximal position in relation to each other and an open position where the locking extremity of said first and second jaws are in a second distal position relative to one another.

2. The powered clamp assembly according to claim 1, wherein said closure device maintains contact with the locking extremity of each one of said first and second jaw when such are in said distal position in relation to each other.

3. The powered clamp assembly according to claim 1, wherein the closure device comprises a powered linear actuator that has reversible and continuously variable position between full extension and full retraction for load holding and locking.

4. The powered clamp assembly according to claim 1, wherein said closure device is operated remotely.

5. The powered clamp assembly according to claim 1, wherein the cylinder arrangement is used to open and close and perform load holding/locking of the first and second jaws together.

6. The powered clamp assembly according to claim 1, wherein the closure device is operated by a linear actuator selected from the group consisting of: a hydraulic actuator; an electric actuator, a mechanically-driven actuator, and a pneumatic actuator.

7. The powered clamp assembly according to claim 1, further comprising a hydraulic cartridge valve for load holding and locking.

8. The powered clamp assembly according to claim 7, wherein the hydraulic cartridge valve is selected from the group consisting of: a counterbalance valve, a pilot-operated check valve, and a load control valve.

9. The powered clamp assembly according to claim 1, wherein the closure device comprises a linear actuator mechanism connecting the locking extremities of said first and second clamp jaw, and performing load holding and locking associated with closure of said clamp.

10. The powered clamp assembly according to claim 1, further comprising an inner circumferential shape created by the first and second jaw when in a closed position such that the inner circumferential shape of the first and second jaw frictionally engages tubing disposed therein.

11. The powered clamp assembly according to claim 1, wherein an internal surface of the first and second jaw comprises at least one groove adapted to contour a rotating control device (RCD) accessory.

12. The powered clamp assembly according to claim 1, wherein the closure device with the multiple opposed cylinder arrangement is operable by way of single or multiple linear actuating mechanisms.

13. The powered clamp assembly according to claim 1, further comprising an alignment mechanism to maintain alignment during operational state transitions.

14. The powered clamp assembly according to claim 1, further comprising a sensor to sense and communicate a state of the closure device.

15. The powered clamp assembly according to claim 14, wherein the sensor is selected from the group consisting of: a proximity sensor; a limit valve; and a limit switch.

16. A powered clamp assembly for use on a rotating control device on a managed pressure drilling rig comprising:

a first jaw with a first locking extremity and a first pivot extremity extending outwardly;

a second jaw comprising a second locking extremity and a second pivot extremity extending outwardly, wherein the first pivot extremity of the first jaw is positioned opposite the second pivot extremity of the second jaw, and wherein the first locking extremity of the first jaw is positioned opposite the second locking extremity of the second jaw;

a bridge pivotally connected to the first pivot extremity of the first jaw and pivotally connected to the second pivot extremity of the second jaw, wherein the bridge maintains a permanent connection between the first and second pivot extremities of the first and second jaws, respectively; and a linear actuator closure device with a multiple opposed cylinder arrangement connecting the first locking extremity of the first jaw to the second locking extremity of the second jaw, wherein the linear actuator allows for movement of the first and second jaws between a closed position where the first and second locking extremities are in a proximal position in relation to each other and an open position where the first and second locking extremities are in a distal position relative to one another.

17. The powered clamp assembly of claim 16, wherein the bridge pivotally connects the first pivot extremity of the first jaw and the second pivot extremity of the second jaw to common pivot point.

* * * * *